US012122545B2

(12) United States Patent
Yang et al.

(10) Patent No.: US 12,122,545 B2
(45) Date of Patent: Oct. 22, 2024

(54) BUNDLING DEVICE AND CABLE PROCESSING SYSTEM

(71) Applicant: Tyco Electronics (Shanghai) Co., Ltd., Shanghai (CN)

(72) Inventors: An (Joshua) Yang, Shanghai (CN); Lvhai (Samuel) Hu, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 244 days.

(21) Appl. No.: 17/726,173

(22) Filed: Apr. 21, 2022

(65) Prior Publication Data

US 2022/0344076 A1 Oct. 27, 2022

(30) Foreign Application Priority Data

Apr. 21, 2021 (CN) ..... 202110433042.4

(51) Int. Cl.

| | |
|---|---|
| ***B65B 27/10*** | (2006.01) |
| ***B65B 13/04*** | (2006.01) |
| ***B65B 13/28*** | (2006.01) |

(52) U.S. Cl.

CPC ..... *B65B 27/10* (2013.01); *B65B 13/04* (2013.01); *B65B 13/28* (2013.01)

(58) Field of Classification Search

CPC ..... B65B 13/04; B65B 13/28; B65B 13/08; B65B 13/12; B65B 13/18; B65B 13/185; B65B 27/10

See application file for complete search history.

(56) References Cited

U.S. PATENT DOCUMENTS

| | | | |
|---|---|---|---|
| 3,234,870 | A | 2/1966 | Missioux |
| 3,470,813 | A | 10/1969 | Nomm et al. |

FOREIGN PATENT DOCUMENTS

| | | | | |
|---|---|---|---|---|
| BE | 690227 | A | | 5/1967 |
| CN | 201457757 | U | | 5/2010 |
| CN | 202063268 | U | | 12/2011 |
| CN | 202464190 | U | * | 10/2012 |
| CN | 202686795 | U | * | 1/2013 |
| CN | 204688470 | U | | 10/2015 |
| CN | 106428844 | A | | 2/2017 |
| CN | 107672839 | A | | 2/2018 |
| CN | 110700595 | A | | 1/2020 |
| CN | 211996293 | U | * | 11/2020 |
| FR | 1306631 | A | | 10/1962 |
| JP | 2002068113 | A | | 3/2002 |

OTHER PUBLICATIONS

Translation of CN-211996293 (Year: 2020).*
Translation of CN-202464190 (Year: 2012).*
Translation of CN-202686795 (Year: 2013).*
Chinese Office Action dated Apr. 28, 2023 with English translation thereof, corresponding to Application No. 2023042800010790, 19 pages.

* cited by examiner

*Primary Examiner* — Bobby Yeonjin Kim
(74) *Attorney, Agent, or Firm* — Barley Snyder

(57) ABSTRACT

A bundling device comprises a frame, and a wire bending device and a wire twisting device each mounted to the frame. The wire bending device bends a bundling wire into an open ring to partially surround an object to be bundled, and guide the bundling wire into the wire twisting device. The wire twisting device twists two opposite end segments of the bundling wire together to bundle the object.

17 Claims, 8 Drawing Sheets

BUNDLING DEVICE AND CABLE PROCESSING SYSTEM

CROSS-REFERENCE TO RELATED APPLICATIONS

This application claims the benefit of Chinese Patent Application No. CN 202110433042.4 filed on Apr. 21, 2021 in the State Intellectual Property Office of China, the whole disclosure of which is incorporated herein by reference.

FIELD OF THE INVENTION

Embodiments of the present disclosure generally relate to the bundling of objects, and more specifically, to a bundling device and a cable processing system including the bundling device.

BACKGROUND

In order to facilitate transportation, storage, operation or management, a variety of objects are usually required to be bundled or wrapped. For example, before wiring or using cables such as optical cables or electric cables, or when selling short cables (such as cables of several meters to more than ten meters), it is necessary to cut off tens of meters or even hundreds of meters of cable, and coil it into a cable roll, and bundle the coiled cable roll.

SUMMARY

According to an embodiment of the present disclosure a bundling device comprises a frame, and a wire bending device and a wire twisting device each mounted to the frame. The wire bending device bends a bundling wire into an open ring to partially surround an object to be bundled, and guide the bundling wire into the wire twisting device. The wire twisting device twists two opposite end segments of the bundling wire together to bundle the object.

BRIEF DESCRIPTION OF THE DRAWINGS

The invention will now be described by way of example with reference to the accompanying Figures, of which.

DETAILED DESCRIPTION OF THE EMBODIMENTS

Figure 1:
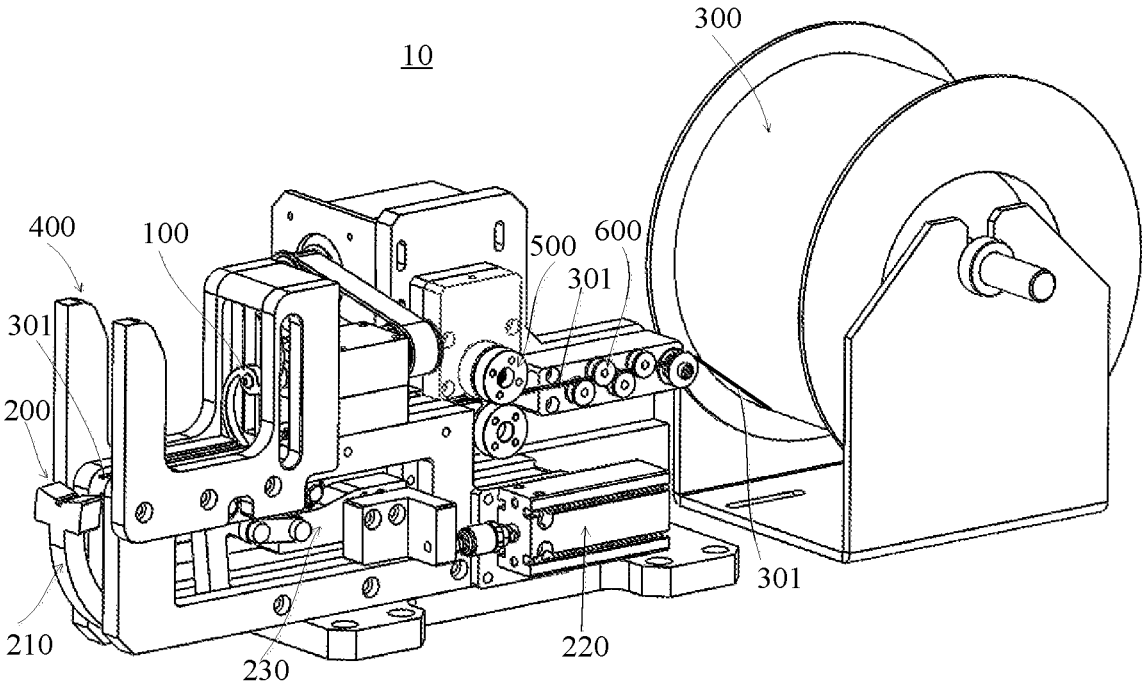
FIG. 1 is a perspective view schematically showing a bundling device according to an exemplary embodiment of the present disclosure.
Figure 2:
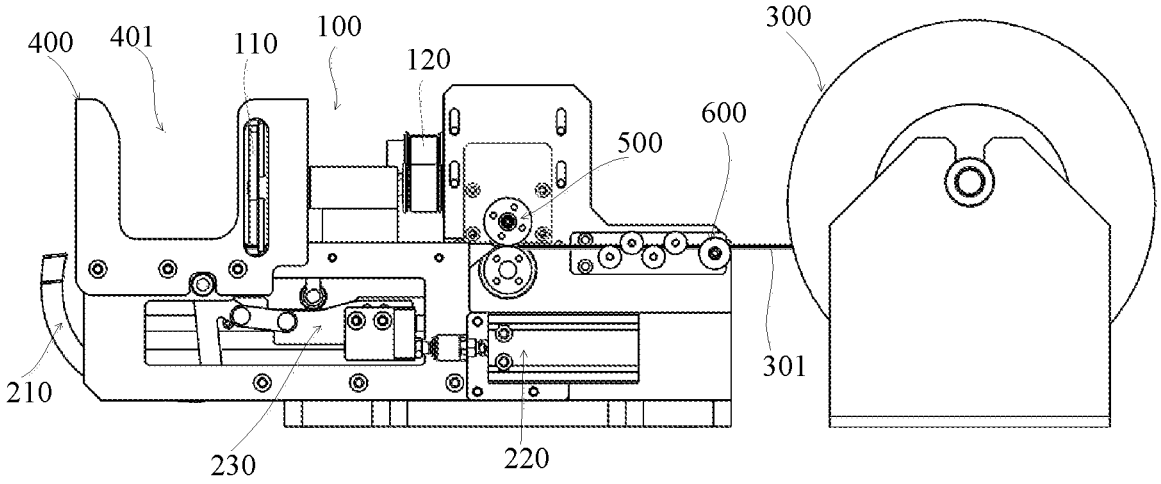
FIG. 2 is a side view schematically showing a bundling device according to an exemplary embodiment of the present disclosure.
Figure 3:
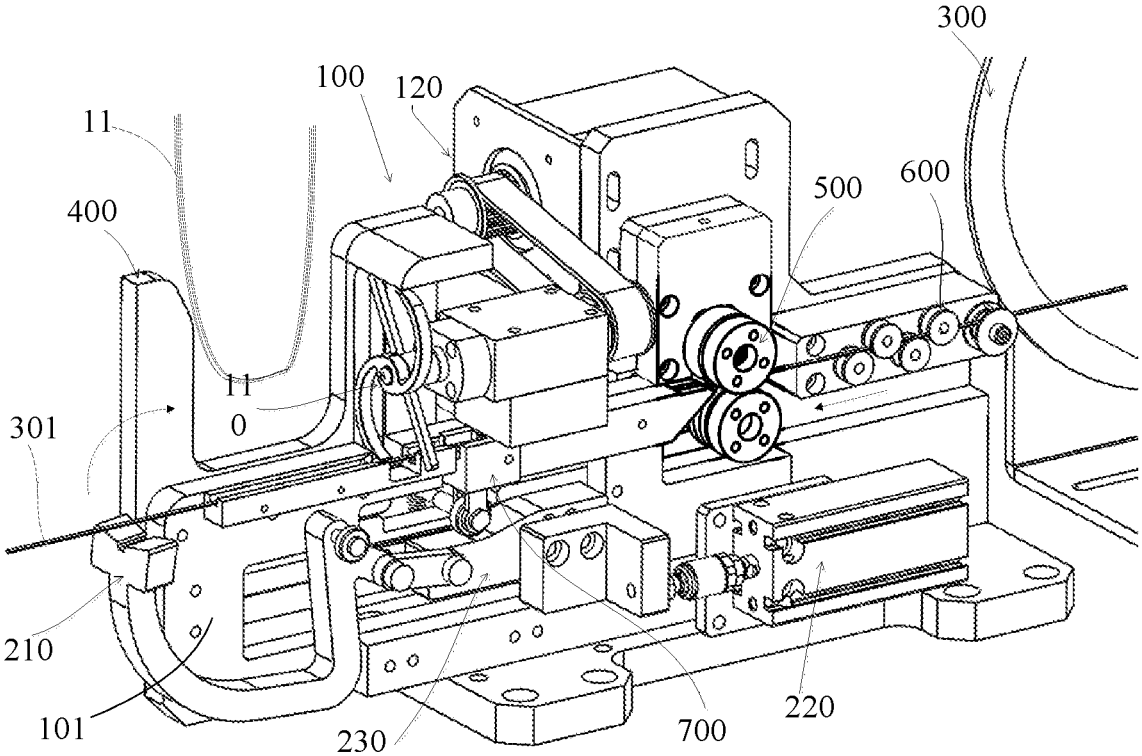
FIG. 3 is another perspective view schematically showing a bundling device according to an exemplary embodiment of the present disclosure, in which some components have been removed to show the internal structure.
Figure 4:
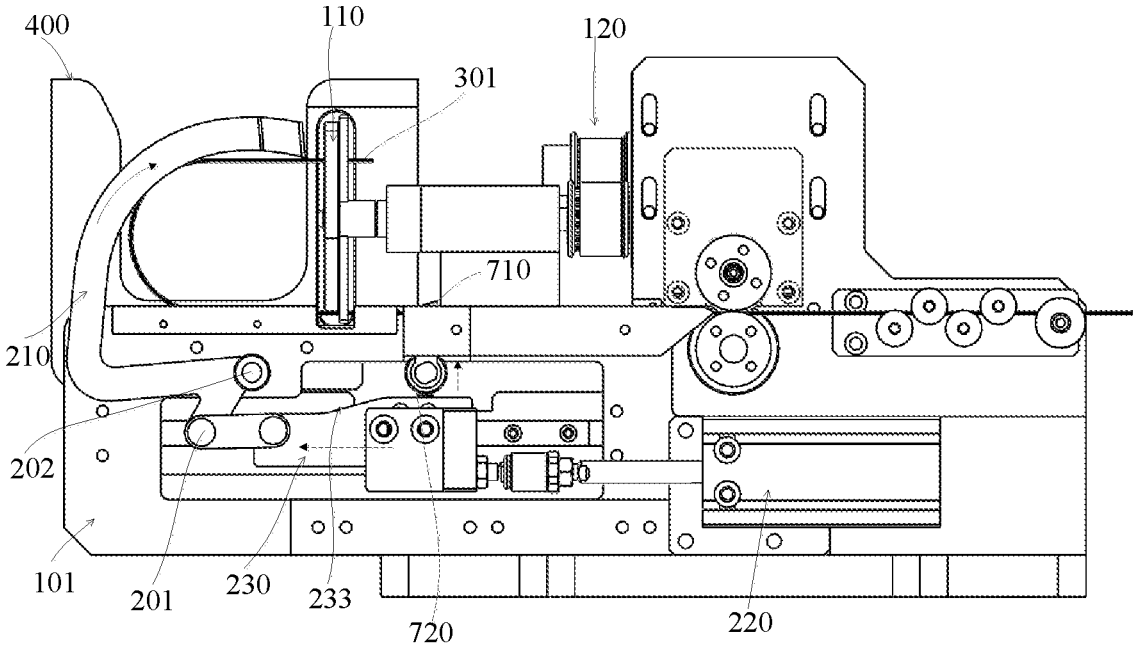
FIG. 4 is another side view schematically showing a bundling device according to an exemplary embodiment of the present disclosure, in which the bundling wire is bent.
Figure 5A:
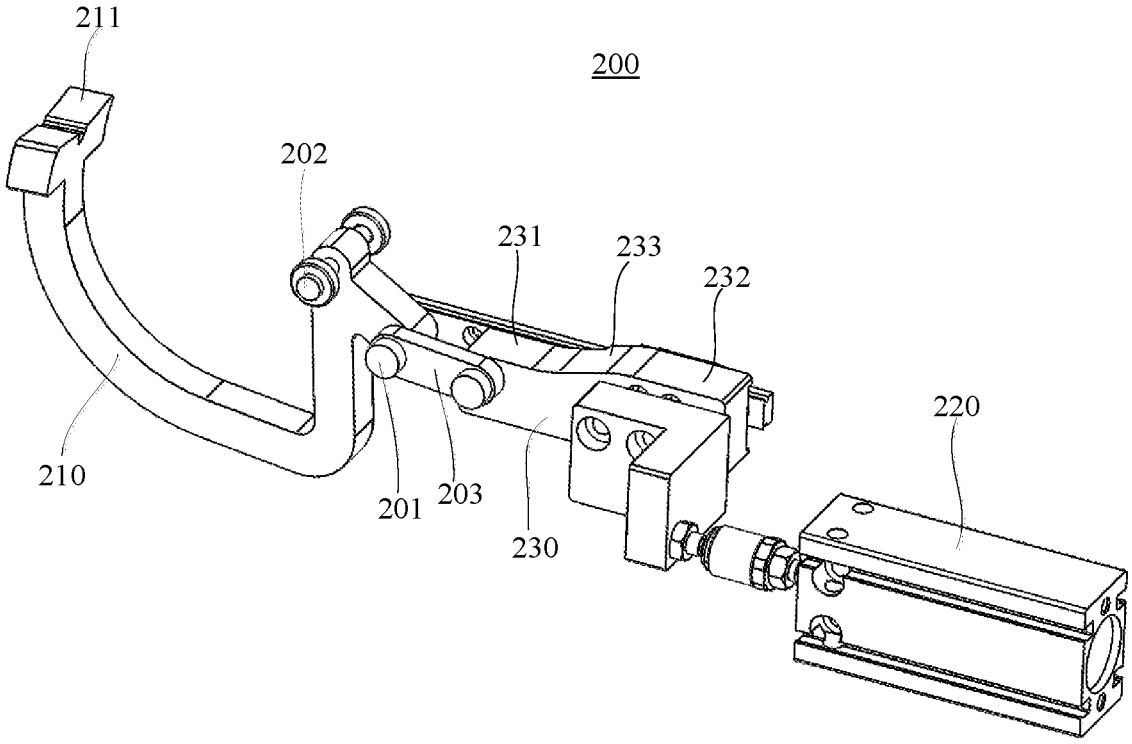
FIG. 5A is a perspective view schematically showing a wire bending device of a bundling device according to an exemplary embodiment of the present disclosure.
Figure 5B:
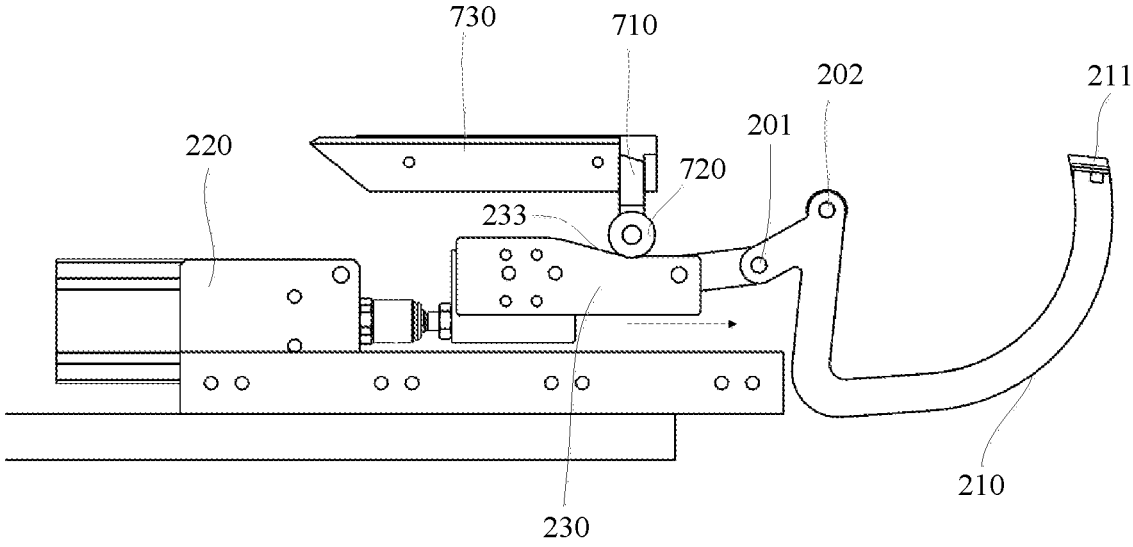
FIG. 5B is a side view schematically showing a wire bending device of a bundling device according to an exemplary embodiment of the present disclosure.
Figure 5C:
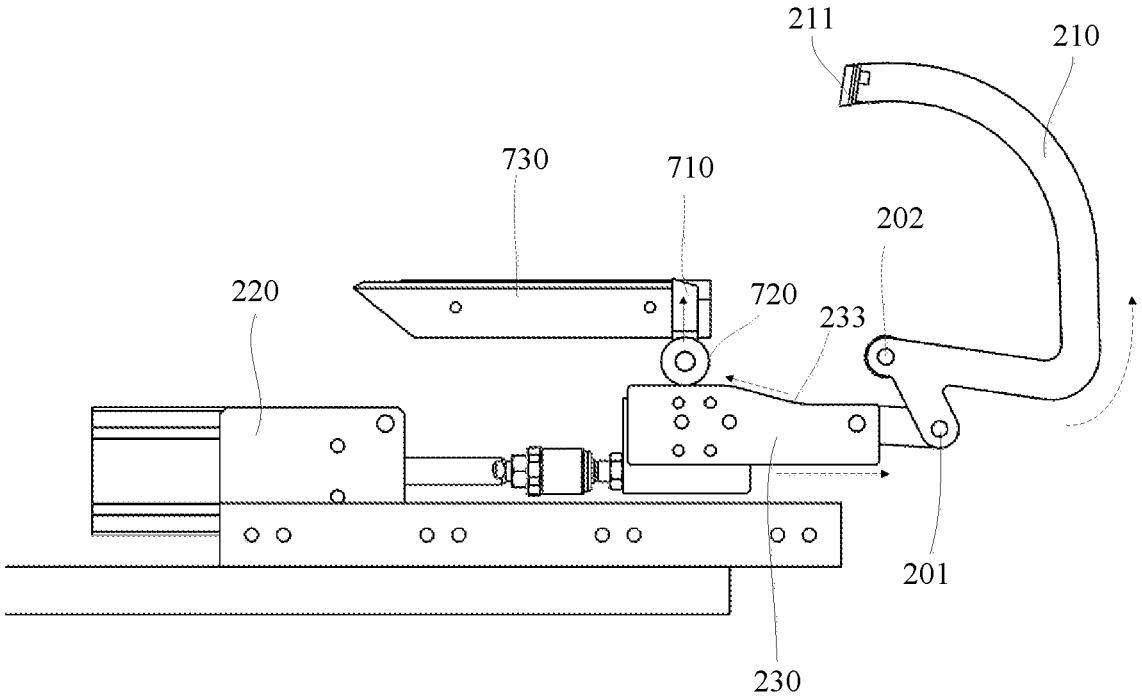
FIG. 5C is another side view schematically showing the wire bending device of the bundling device according to the exemplary embodiment of the present disclosure, wherein the wire bending mechanism is in a state of bending the bundling wire.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a bundling device comprises a frame and a wire twisting device and a wire bending device mounted to the frame. The wire bending device bends a bundling wire into an open ring to partially surround an object to be bundled and guides the bundling wire into the wire twisting device. The wire twisting device twists two opposite end segments of the bundling wire together to bundle the object. The bundling device can operate as an independent workstation or on an automatic production line, and is suitable for bundling objects of various sizes with a bundling wire. For example, the device can be used for bundling cable roll such as electric cables and optical cables for subsequent processing.

In the illustrated embodiment, the bundling device 10 includes a frame 101, a wire twisting device 100 and a wire bending device 200 installed to the frame 101. When bundling an object, the wire bending device 200 is used to bend a bundling wire 301 fed from a spool 300 into an open ring form so that the bundling wire 301 in the open ring form at least partially surrounds the object 11 to be bound. The wire bending device 200 also guides the bent bundling wire, such as the front section of the bundling wire, into the wire twisting device 100, which is used to twist the opposite end segments 302 and 303 (E. G., see FIG. 7B) of the bent bundling wire together to bundle the object 11.

As shown in FIGS. 1-4 and 7A, the bundling device 10 may also include an object receiving structure 400, which includes, for example, two U-shaped opening plates spaced apart. The receiving structure 400 defines an accommodation space 401 for receiving at least the part to be bound of the object 11, such as a part of the cable roll, which is positioned in the object receiving structure 400 in a manner that its radial direction is roughly perpendicular to or inclined to the feeding direction of the bundling wire 301. The bundling wire in the form of opening ring can extend over the radial inner and outer sides of the cable roll, so that opposite end segments of the bundling wire can be located on the same side of the object or cable roll and have been twisted and wound together. In the illustrated example, the feeding path of the bundling wire 301 is partially located between two plates of the object receiving structure 400.

As shown in FIGS. 1-4, the bundling device 10 may also include a wire feeding mechanism 500, which includes, for example, two or more feeding rollers located on opposite sides of the bundling wire 301 to feed the bundling wire 301 from the spool 300 (E. G., horizontally or along a straight line in the drawings) to a position close to the object 11. The bundling wire passes over from radial outside of the object or below the object and continues to travel a predetermined distance until reach a position where the bundling wire can be joined and bent by the wire bending device 200, so that the bundling wire with a length sufficient to bundle the object can be bent for bundling the object. The bundling device 10 may also include a wire straightening mechanism 600, which may be located upstream of the wire feeding mechanism 500 along the feeding direction of the bundling wire, for example, including two or more rollers located on opposite sides of the bundling wire 301 for straightening or flattening the bundling wire from the spool 300 for feeding.

Still referring to FIGS. 1-4, the bundling device 10 may also include a wire cutting mechanism 700. The wire cutting mechanism 700 may be located between the wire feeding mechanism 500 and the wire twisting device 100 along the feeding direction of the bundling wire, so as to cut the bundling wire after the wire feeding mechanism 500 has fed the bundling wire with sufficient length. The most front end (i.e., guided to one end of the wire twisting device 100 by the wire bending device 200) and the cut end of the bundling wire are twisted and wound together to bundle the object 11.

As shown in FIGS. 1-4 and 6A to 7B, the wire twisting device 100 includes a wire twisting mechanism 110, which includes a wire twisting structure 111, and is adapted to twist and wind the opposite end segments of the bundling wire 301 together by rotation. The wire twisting device 100 may also include a first driving mechanism 120, such as a motor. The first driving mechanism 120 is used to drive the wire twisting structure 111 to rotate during bundling the object 11 by the bundling wire 301. The first drive mechanism 120 may drive the wire twisting structure 111 to rotate directly or indirectly by means of a belt 130 and a shaft 117.

For example, as shown, the wire twisting structure 111 has an S-shaped or a reverse S-shaped profile. The wire twisting structure 111 may have two C-shaped parts 112 which are connected together at the center of the wire twisting structure 111 (e.g., at the center hole 113). Each C-shaped part 112 is adapted to engage an end segment 302 or 303 of the bundling wire during bundling an object with the bundling wire 301, so that the opposite end segments 302 and 303 of the bundling wire are twisted and wound with each other by the rotation of the wire twisting structure 111. Specifically, when bundling, the opposite end segments are respectively located in the opening of the C-shaped part, and are pushed to move toward the center of the wire twisting structure by means of the rotation of the wire twisting structure 111. The further rotation of the wire twisting structure 111 twists and winds the opposite end segments together in a spiral manner to realize the bundling of the object. The wire twisting structure 111 may be mounted on a shaft 117 extending through the center hole 113, and the first driving mechanism 120 drives the shaft 117 to rotate, for example, by means of a belt 130, and the shaft 117 drives the wire twisting structure 111 to rotate.

Figure 7A:
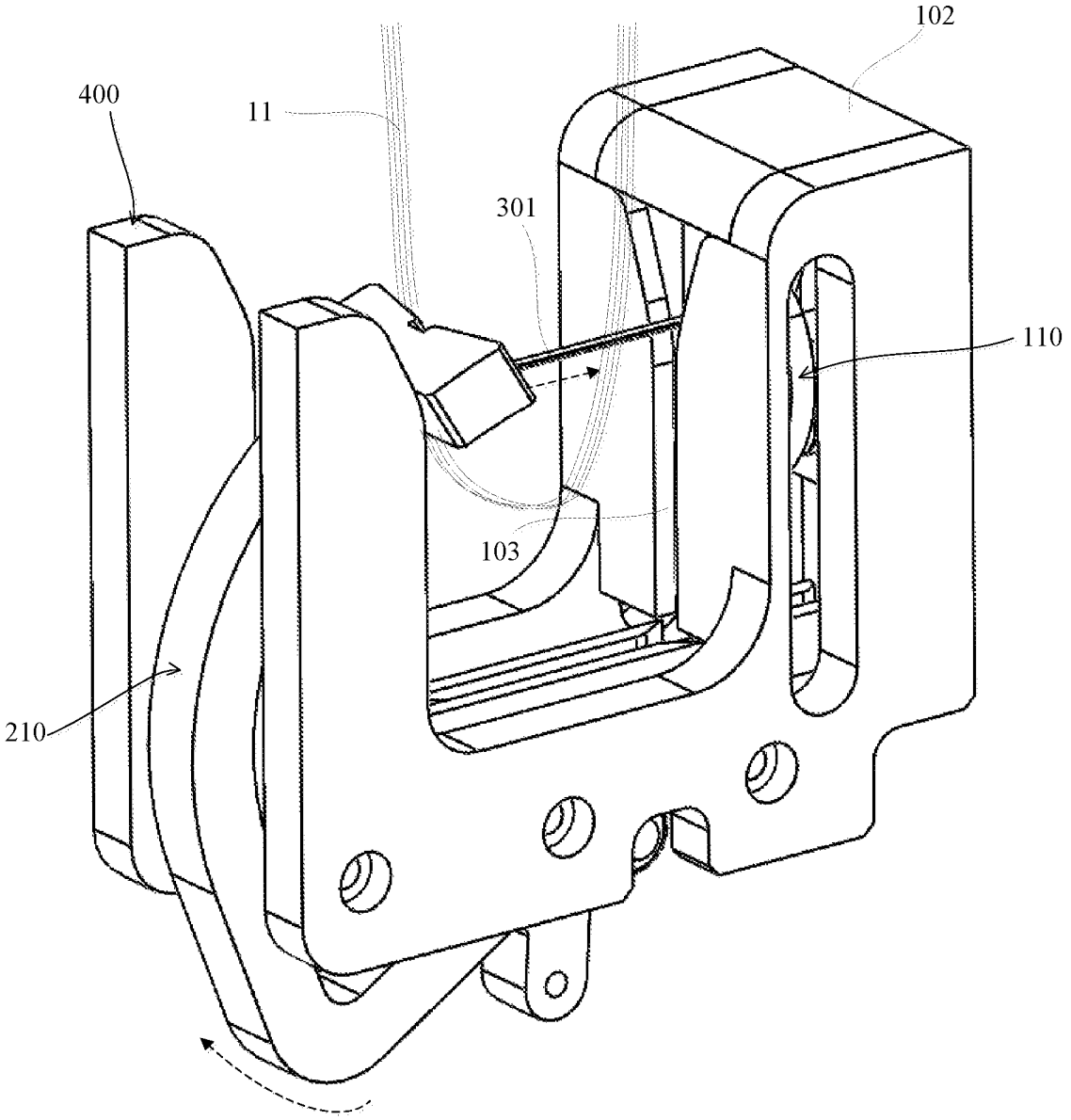
FIGS. 7A and 7B are schematic diagrams showing the cooperation of the wire bending mechanism and the wire twisting mechanism of the bundling device according to the exemplary embodiment of the present disclosure, respectively.
Figure 7B:
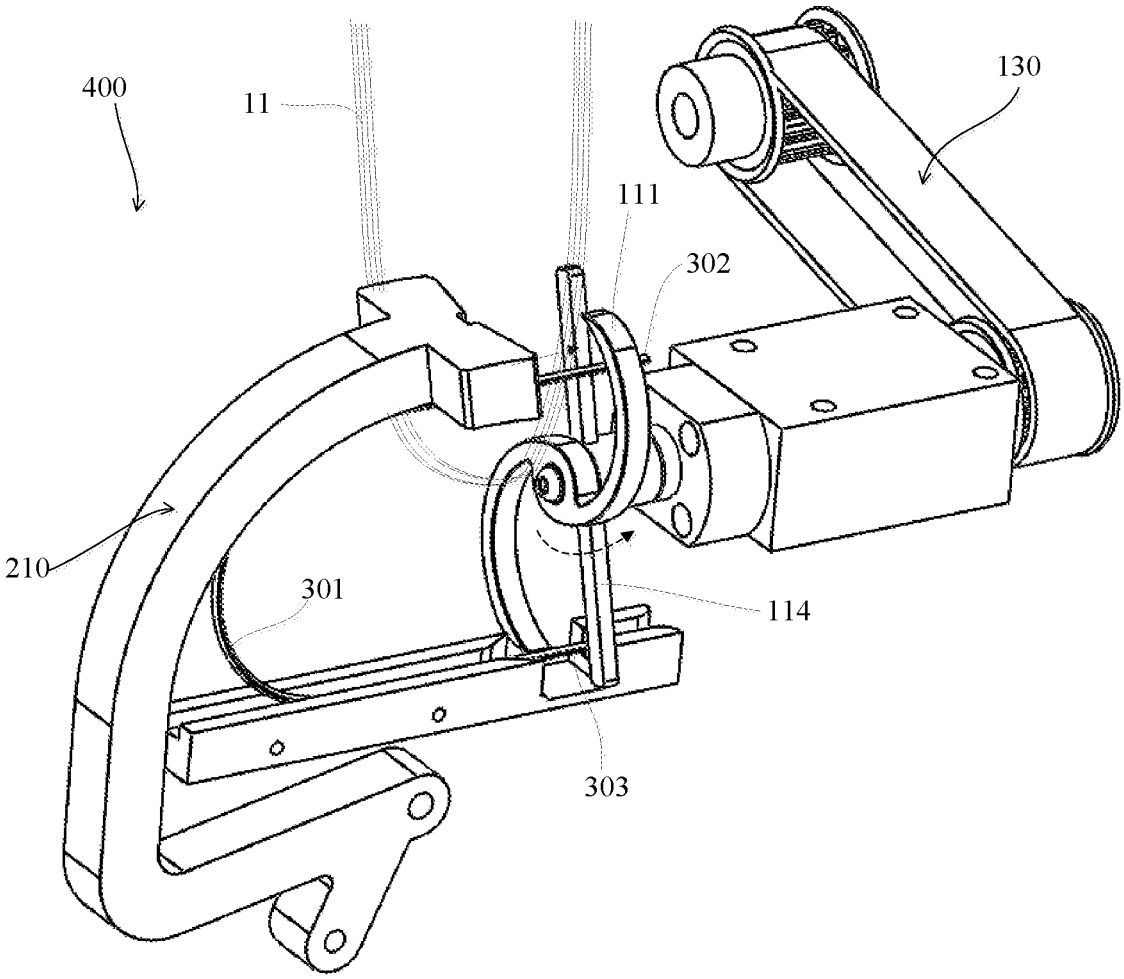

In the exemplary embodiment, the wire twisting mechanism 110 also includes a straight rod 114, which is rotatably mounted on the shaft 117 at the center hole 116, for example, that is, the rotation of the shaft 117 does not drive the straight rod 114 to rotate. The straight rod 114 can be positioned so that the opposite end segments 302 and 303 of the bundling wire 301 can be positioned on the opposite sides of the straight rod 114, as shown in FIG. 7B. When the wire twisting structure 111 is rotated, it drives the opposite end segments 302 and 303 to move along the straight rod 114 from the opposite ends of the straight rod 114 toward the center of the straight rod 114, so as to twist and wind the opposite end segments 302 and 303 together.

As shown in FIGS. 1-4, 7A and 7B, the wire twisting structure 111 and the straight rod 114 can be at least partially located between the two plates of the object receiving structure 400, for example, they are surrounded or accommodated in the housing 102 to avoid the external interference. One side of the housing 102 can be provided with a slit 103 so that the bent bundling wire by the wire bending device 200 can enter into the wire twisting structure 111 through the slit 103. In an exemplary embodiment according to the present disclosure, the feeding path of the bundling wire 301 is within the rotation radius of both the wire twisting structure 111 and the straight rod 114 so that the wire twisting structure 111 can connect and twist the bundling wire. For example, the length of the straight rod 114 may be slightly larger than the diameter of the wire twisting structure 111.

In some examples, the straight rod 114 is pressed against one side of the wire twisting structure 111 so that the straight rod 114 remains basically stationary during the rotation of the wire twisting structure 111 through the shaft 117, or the straight rod 114 rotates slightly due to the counter pressure exerted on the twisted end segments along the rotation direction of the wire twisting structure, but this rotation of the straight rod 114 is significantly slower than that of the wire twisting structure 111. In this way, it facilitates the twisting of the bundling wire by the bundling wire twisting structure 111.

Figure 6A:
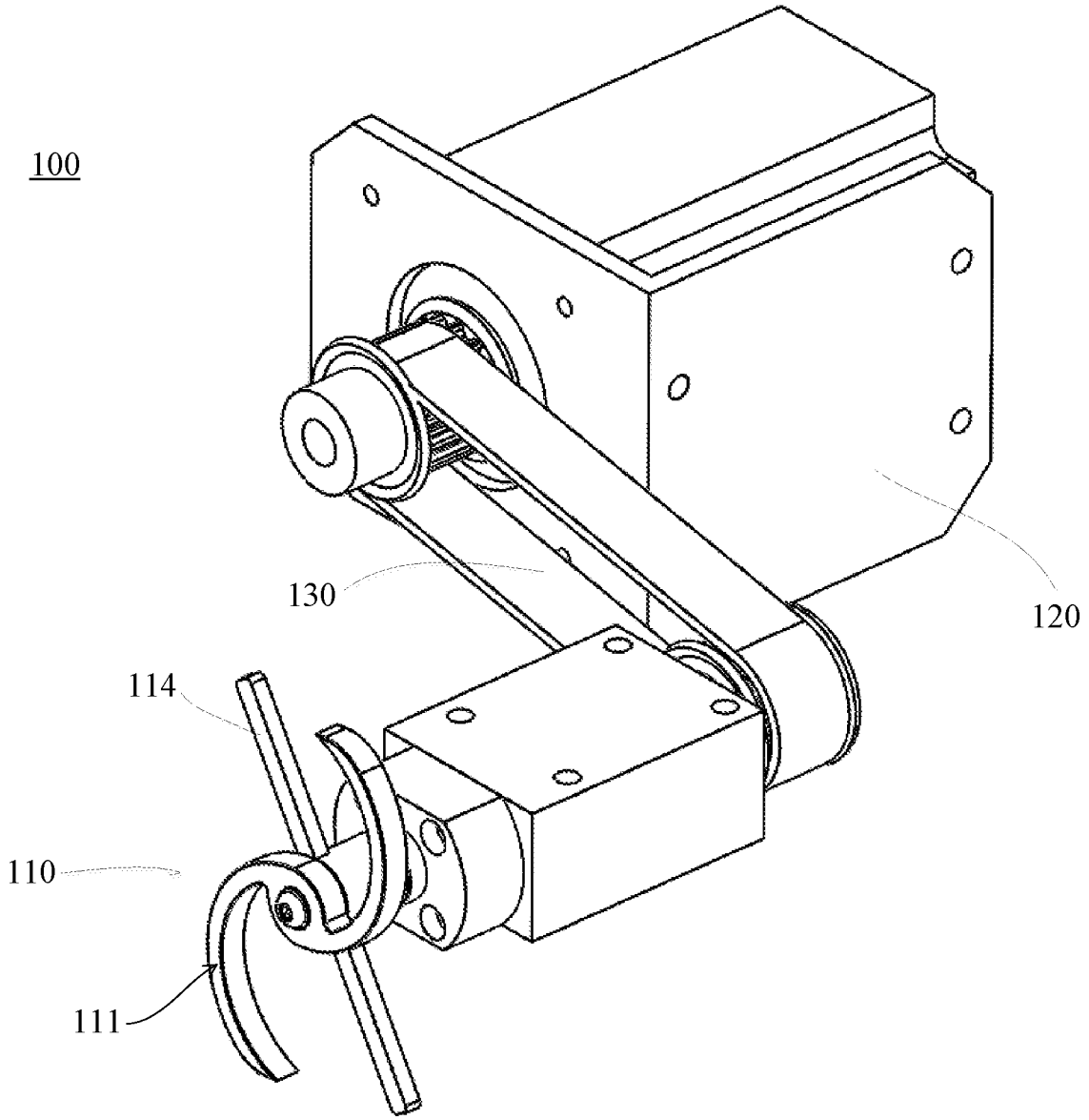
FIG. 6A is a perspective view schematically showing a wire twisting device of a bundling device according to an exemplary embodiment of the present disclosure.
Figure 6B:
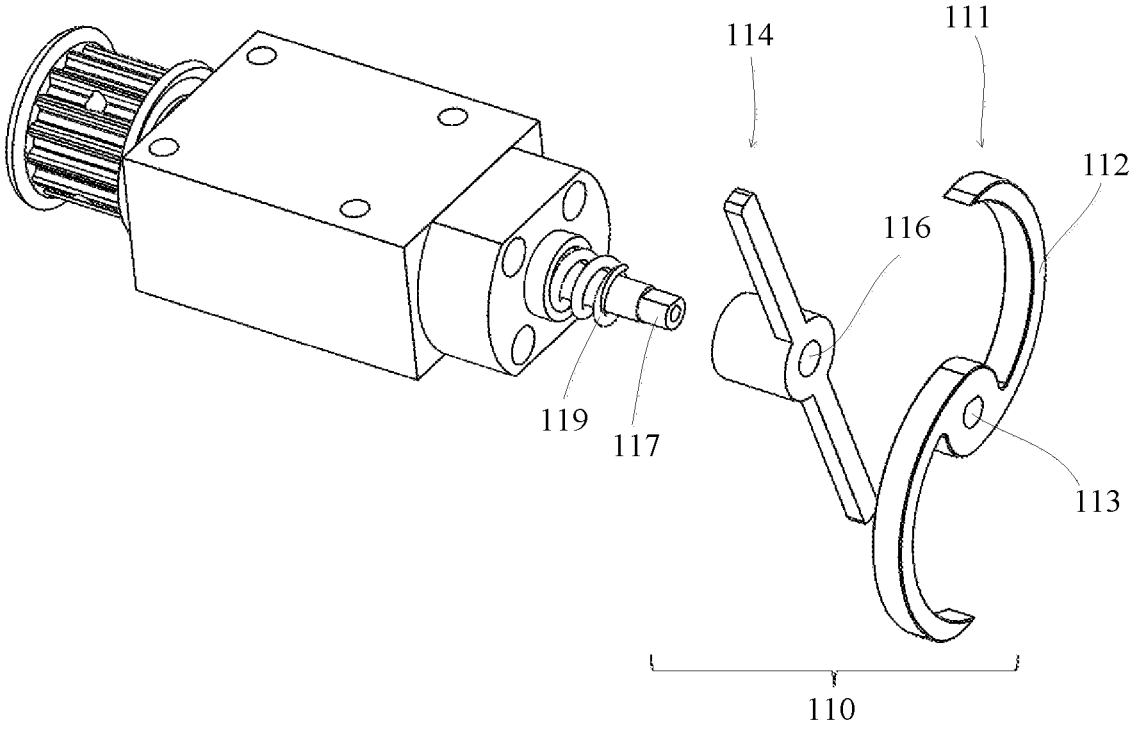
FIG. 6B is an exploded view schematically showing a wire twisting device of a bundling device according to an exemplary embodiment of the present disclosure.
Figure 6C:
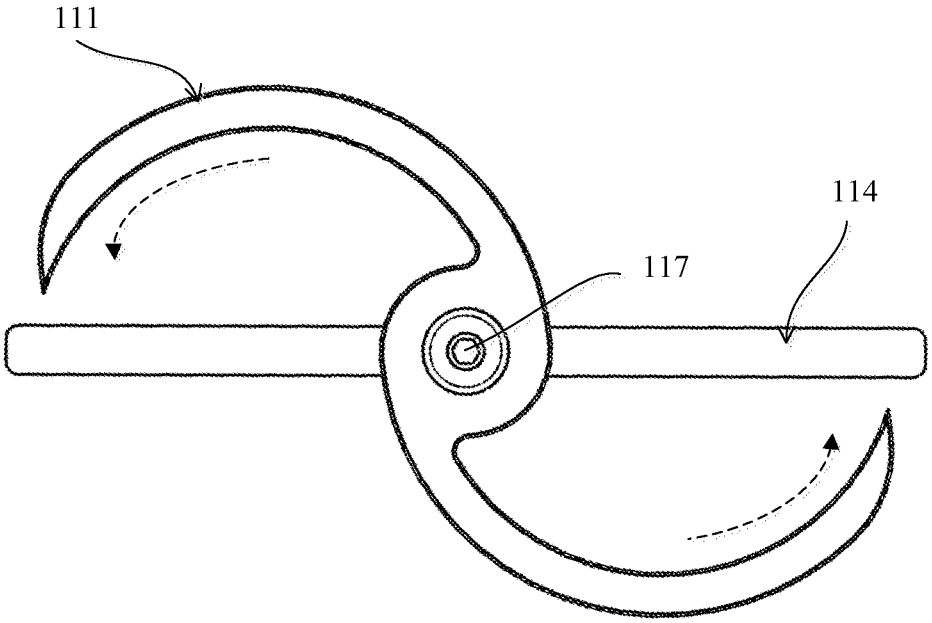
FIG. 6C is a side view schematically showing a wire twisting mechanism of a bundling device according to an exemplary embodiment of the present disclosure.

As shown in FIG. 6B, the wire twisting mechanism 110 may also include a spring 119. The spring 119 may be sleeved on the shaft 117 and positioned on the side of the straight rod 114 opposite to the wire twisting structure 111 to press the straight rod 114 against the wire twisting structure 111. According to an exemplary embodiment of the present disclosure, the wire twisting structure 111 can sufficiently twist the opposite end segments 302 and 303 of the bundling wire 301 so that the opposite end segments twisted together can produce a force sufficient to push the straight rod 114 to compress the spring 119 and push the straight rod 114 away from the wire twisting structure 111 until the straight rod 114 is separated from the twisted opposite end segments. At the same time, the wire twisting structure 111 stops rotating to avoid excessive twisting of the bundling wire and damage the bundling wire or the object.

In the illustrated embodiment, as shown in FIGS. 1-5C, 7A and 7B, the wire bending device 200 includes a wire bending mechanism 210 installed to be able to pivot. The wire bending mechanism 210 is configured to engage the bundling wire 301, for example, in a direction opposite to the feeding direction of the bundling wire, so as to reverse bend the bundling wire 301 fed along a straight line into the form of an open ring partially around the object 11 to be bound. A second driving mechanism 220 is provided to drive the wire bending mechanism 210 to pivot. The wire bending mechanism 210 has a first end and an opposite second end 211. The second end 211 is configured to engage with the bundling wire 301 when bending the bundling wire 301. For example, the second end 211 may have a roughly Y-shaped structure with a groove for engaging the bundling wire 301.

The wire bending device 200 also includes a connecting member 230, one end of which is connected to the second driving mechanism 220, and the other end of the connecting member 230 is rotatably connected to the first end of the wire bending mechanism 210 (e.g., by means of a pivot 201). In the illustrated example, the other end of the connecting member 230 is connected to the first end of the wire bending mechanism 210 at the pivot 201 by means of the connecting rod 203. The second driving mechanism 220 can drive the connecting member 230 to move linearly in a direction parallel to the feeding direction of the bundling wire 301 to push the wire bending mechanism 210 (e.g., reverse) to pivot via the connecting member 230.

In the illustrated embodiment, the wire bending device 200 is positioned below the wire bundling device 100, so the wire bending mechanism 210 pivots from bottom to top and pivots in a direction opposite to the feeding direction of the bundling wire 301 to reverse bend the bundling wire 301.

As shown in FIGS. 1-5C, the wire bending mechanism 210 has a pivot center point between the first end and the second end 211 (e.g., by means of a pivot 202). The wire bending mechanism 210 can be pivotally mounted to the frame 101 so that the wire bending mechanism 210 pivots about the pivot center point under the drive of the second driving mechanism 220 to bend the bundling wire 301 engaged with the second end 211 in a direction opposite to the feeding direction. For example, as shown in the figure, the wire bending mechanism 210 has a roughly hook shaped profile, including a roughly C-shaped part with the second end 211 and the pivot center point as two end points, and a roughly linear connecting part extending obliquely from the pivot center point to the first end. The linear movement of the connecting member 230 driven by the second driving mechanism 220 pushes the connecting part to pivot around the pivot center point. The C-shaped part is located below the feeding path of the bundling wire and faces the upper opening during the feeding of the bundling wire. During the bending of the bundling wire, by means of the pivoting of the connecting part, for example, pivoting between the two plates of the wire receiving structure 400 and finally making the opening face the wire twisting mechanism 110, the bending of the bundling wire is realized and the front end of the bundling wire is guided into the wire twisting mechanism 110.

As shown in FIGS. 1-5C, the upper surface of the connecting member 230 includes a first flat section 231 and a second flat section 232 connected by an inclined section 233, and the second flat section 232 is higher than the first flat section 231. The wire cutting mechanism 700 includes a cutter 710 and a roller 720 supporting the cutter 710. The cutter 710 can extend in a vertical direction, for example, and is located below the feeding path during the feeding of the bundling wire 301.

For example, the roller 720 is movably positioned on the upper surface of the connecting member 230 and is supported on the first flat section 231 during the feeding of the bundling wire 301 (see, for example, FIG. 5B), while the connecting member 230 is driven to move linearly in a direction parallel to the feeding direction of the bundling wire 301. The roller 720 moves or slides from the first flat section 231 to the second flat section 232 along the inclined section 231 relative to the connecting member 230 (see, for example, FIG. 5C).

In this way, the roller 720 and the cutter 710 are fixed relative to the frame 101 in the feeding direction or horizontal direction, but the linear movement of the connecting member 230 causes the roller 720 to move in the vertical direction from the lower first flat section 231 to the higher second flat section 232 through the inclined section 231 relative to the connecting member 230, so that the roller 720 is positioned or supported on the second flat section 232. As a result, the cutter 710 supported by the roller 720 protrudes upward into the feeding path to cut off the bundling wire 301.

By way of example, the wire cutting mechanism 700 may also include a wire guide 730 fixed to the frame 101, for example, and positioned at least between the wire feeding mechanism 500 and the wire twisting mechanism 110 along the feeding path of the bundling wire 301 to guide the feeding of the bundling wire. Moreover, the wire guide 730 may be provided with a through hole extending in the vertical direction, and the cutter 710 is at least partially positioned in the through hole. That is, during the feeding of the binding wire, at least the blade of the cutter is hidden in the through hole, and the vertical movement of the roller 720 relative to the upper surface of the connecting member 230 drives the cutter 710 to move vertically, so as to realize the hiding, protruding and cutting of the cutter.

When the second driving mechanism 220 drives the connecting member 230 to move linearly to drive the wire bending mechanism 210 to pivot, and when the wire bending mechanism 210 bends the bundling wire 301 into a suitable shape and partially guides the bundling wire into the wire twisting mechanism 110, the linear movement of the connecting member 230 causes the roller 720 to be positioned on the higher second flat section of the upper surface of the connecting member 230. Thus, after the bundling wire is properly bent by the wire bending mechanism, the bundling wire is cut in time, so that the wire twisting mechanism can twist the bundling wire.

The exemplary embodiment of the present disclosure also provides an object processing system, such as a cable processing system, which includes a bundling device described in any embodiment herein. The bundling device is used to bundle an object, such as a coiled cable roll 11, with a bundling wire 301 from the spool 300 for subsequent processing of the object, such as transportation, storage, wiring, etc.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A bundling device, comprising:

a frame; and a wire bending device mounted to the frame and adapted to bend a bundling wire into an open ring to partially surround an object to be bundled and guide the bundling wire into a wire twisting device, the wire twisting device mounted to the frame and adapted to twist two opposite end segments of the bundling wire together to bundle the object, the wire bending device includes:

a wire bending mechanism pivotally mounted on the frame and configured to engage the bundling wire and bend the bundling wire into the open ring, the wire bending mechanism has a first end and a second end opposite to each other, and the second end is configured to engage with the bundling wire when bending the bundling wire;

a second driving mechanism configured to drive the wire bending mechanism to pivot; and a connecting member, one end of the connecting member is connected to the second driving mechanism, and the opposite end of the connecting member is rotatably connected with the first end of the wire bending mechanism, an upper surface of the connecting member includes a first flat section and a second flat section connected by an inclined section, the second flat section is higher than the first flat section.

2. The bundling device according to claim 1, wherein the wire twisting device comprises:

a wire twisting mechanism including a rotatable wire twisting structure which is adapted to twist and wind the opposite end segments of the bundling wire together by rotation; and a first driving mechanism driving the wire twisting structure to rotate during the object is bundled by the bundling wire.

3. The bundling device according to claim 2, wherein the wire twisting structure has an S-shaped or a reverse S-shaped profile.

4. The bundling device according to claim 2, wherein the wire twisting structure has two C-shaped parts with opposite openings and connected together at the center of the wire twisting structure.

5. The bundling device according to claim 4, wherein each C-shaped part is adapted to engage an end segment of the bundling wire during bundling the object with the bundling wire, so that the opposite end segments of the bundling wire are twisted and wound together by the rotation of the wire twisting structure.

6. The bundling device according to claim 2, wherein the wire twisting mechanism further comprises a shaft, the wire twisting structure is installed on the shaft.

7. The bundling device according to claim 6, wherein the first driving mechanism drives the shaft to rotate during bundling the object with the bundling wire, so as to drive the wire twisting structure to rotate by the shaft.

8. The bundling device according to claim 7, wherein the wire twisting mechanism includes a straight rod, the center of the straight rod is rotatably mounted on the shaft, and the straight rod is positioned so that the opposite end segments of the bundling wire are located at opposite sides of the straight rod.

9. The bundling device according to claim 8, wherein when the wire twisting structure is rotated, the wire twisting structure drives the opposite end segments of the bundling wire to move along the straight rod from the opposite ends of the straight rod towards the center of the straight rod, so as to twist and wind the opposite end segments together.

10. The bundling device according to claim 9, wherein the straight rod is pressed against one side of the wire twisting structure, and the straight rod remains stationary or rotates slower than the wire twisting structure during the wire twisting structure is rotated by the shaft.

11. The bundling device according to claim 10, wherein the wire twisting mechanism further comprises a spring positioned on a side of the straight rod opposite to the wire twisting structure to press the straight rod against the wire twisting structure.

12. The bundling device according to claim 11, wherein when the opposite end segments of the bundling wire are twisted by the wire twisting structure, the twisted opposite end segments produce a force sufficient to push the straight rod to compress the spring, so as to separate the straight rod from the twisted opposite end segments.

13. The bundling device according to claim 1, wherein the second driving mechanism is configured to drive the connecting member to move linearly in a direction parallel to the feeding direction of the bundling wire to push the wire bending mechanism to pivot via the connecting member.

14. The bundling device according to claim 13, wherein the wire bending mechanism is pivotally mounted to the frame with a pivot center point between the first end and the second end, and the wire bending mechanism pivots under the drive of the second driving mechanism to bend the bundling wire engaged with the second end toward a direction opposite to the feeding direction.

15. The bundling device according to claim 14, wherein the wire bending mechanism has a hook profile and comprises:

a C-shaped part with the second end and the pivot center point as two end points thereof, and a connecting part extending obliquely from the pivot center point toward the first end of the wire bending mechanism.

16. The bundling device according to claim 14, wherein:

the wire bending device is positioned below the feeding path of the bundling wire;

wherein the bundling device also includes a wire cutting mechanism which includes a cutter and a roller supporting the cutter, the cutter is located below the feeding path during the feeding of the bundling wire, and the roller is movably positioned on the upper surface of the connecting member; and wherein while the connecting member is driven to move linearly in a direction parallel to the feeding direction of the bundling wire, the roller moves from the first flat section to the second flat section along the inclined section relative to the connecting member, so that the cutter is protruded upward into the feeding path to cut off the fed bundling wire.

17. A cable processing system, comprising:

a spool of bundling wire; and a bundling device, comprising:

a frame; and a wire bending device mounted to the frame and bending the bundling wire into an open ring to partially surround a coiled cable roll to be bundled and guide the bundling wire into a wire twisting device, the wire twisting device mounted to the frame and adapted to twist two opposite end segments of the bundling wire together to bundle the coiled cable roll, the wire bending device includes:

a wire bending mechanism pivotally mounted on the frame and configured to engage the bundling wire and bend the bundling wire into the open ring, the wire bending mechanism has a first end and a second end opposite to each other, and the second end is configured to engage with the bundling wire when bending the bundling wire;

a driving mechanism configured to drive the wire bending mechanism to pivot; and a connecting member, one end of the connecting member is connected to the driving mechanism, and the opposite end of the connecting member is rotatably connected with the first end of the wire bending mechanism, an upper surface of the connecting member includes a first flat section and a second flat section connected by an inclined section, the second flat section is higher than the first flat section.

* * * * *